US008132624B2

(12) United States Patent
Johnson et al.

(10) Patent No.: US 8,132,624 B2
(45) Date of Patent: Mar. 13, 2012

(54) PERMEABILITY FLOW BALANCING WITHIN INTEGRAL SCREEN JOINTS AND METHOD

(75) Inventors: Michael H. Johnson, Katy, TX (US); Namhyo Kim, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 233 days.

(21) Appl. No.: 12/476,843

(22) Filed: Jun. 2, 2009

(65) Prior Publication Data

US 2010/0300691 A1 Dec. 2, 2010

(51) Int. Cl.
*E21B 43/24* (2006.01)

(52) U.S. Cl. ..... 166/303; 166/270; 166/272.3

(58) Field of Classification Search ..... 166/303, 166/50, 272.7, 191, 273.3, 302, 272.1, 272.3
See application file for complete search history.

(56) References Cited

U.S. PATENT DOCUMENTS

| | | | |
|---|---|---|---|
| 1,362,552 | A | 12/1920 | Alexander et al. |
| 1,488,753 | A | 4/1924 | Kelly |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,391,609 | A | 12/1945 | Wright |
| 2,412,841 | A | 12/1946 | Spangler |
| 2,762,437 | A | 9/1956 | Egan et al. |
| 2,804,926 | A | 9/1957 | Zublin |
| 2,810,352 | A | 10/1957 | Tumlison |
| 2,814,947 | A | 12/1957 | Stegemeier et al. |
| 2,942,668 | A | 6/1960 | Maly et al. |
| 2,945,541 | A | 7/1960 | Maly et al. |
| 3,103,789 | A | 9/1963 | McDuff |
| 3,240,274 | A | 3/1966 | Solum |
| 3,273,641 | A | 9/1966 | Bourne |
| 3,302,408 | A | 2/1967 | Schmid |
| 3,322,199 | A | 5/1967 | Van Note, Jr. |
| 3,326,291 | A | 6/1967 | Zandmer |
| 3,333,635 | A | 8/1967 | Crawford |
| 3,385,367 | A | 5/1968 | Kollsman |
| 3,386,508 | A | 6/1968 | Bielstein et al. |

(Continued)

FOREIGN PATENT DOCUMENTS

CN 1385594 12/2002

(Continued)

OTHER PUBLICATIONS

International Search Report; Date of Mailing Jan. 27, 2011; International Application No. PCT/US2010/034752; 3 pages.

(Continued)

*Primary Examiner* — Kenneth L Thompson
*Assistant Examiner* — Jacob Hall
(74) *Attorney, Agent, or Firm* — Cantor Colburn LLP

(57) ABSTRACT

A method for uniform heating of a formation including applying a high temperature fluid to a tubular located within an open hole formation borehole; modifying a permeability of the tubular along its length by reducing permeability at a heel of the borehole and by increasing permeability towards a toe of the borehole; and impeding annular movement of the heated fluid by radially extending one or more baffles from the tubular.

12 Claims, 2 Drawing Sheets

U.S. PATENT DOCUMENTS 3,419,089 A 12/1968 Venghiattis
3,451,477 A 6/1969 Kelley
3,468,375 A 9/1969 States
RE27,252 E 12/1971 Sklar et al.
3,675,714 A 7/1972 Thompson
3,692,064 A 9/1972 Hohnerlein et al.
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
3,958,649 A 5/1976 Bull et al.
3,975,651 A 8/1976 Griffiths
4,153,757 A 5/1979 Clark, III
4,173,255 A 11/1979 Kramer
4,180,132 A 12/1979 Young
4,186,100 A 1/1980 Mott
4,187,909 A 2/1980 Erbstoesser
4,245,701 A 1/1981 Chambers
4,248,302 A 2/1981 Churchman
4,250,907 A 2/1981 Struckman et al.
4,257,650 A 3/1981 Allen
4,265,485 A 5/1981 Boxerman et al.
4,278,277 A 7/1981 Krijgsman
4,283,088 A 8/1981 Tabakov et al.
4,287,952 A 9/1981 Erbstoesser
4,390,067 A 6/1983 Willman
4,398,898 A 8/1983 Odom
4,410,216 A 10/1983 Allen
4,415,205 A 11/1983 Rehm et al.
4,434,849 A 3/1984 Allen
4,463,988 A 8/1984 Bouck et al.
4,484,641 A 11/1984 Dismukes
4,491,186 A 1/1985 Alder
4,497,714 A 2/1985 Harris
4,512,403 A 4/1985 Santangelo et al.
4,552,218 A 11/1985 Ross et al.
4,552,230 A 11/1985 Anderson et al.
4,572,295 A 2/1986 Walley
4,576,404 A 3/1986 Weber
4,577,691 A 3/1986 Huang et al.
4,614,303 A 9/1986 Moseley, Jr. et al.
4,649,996 A 3/1987 Kojicic et al.
4,817,710 A 4/1989 Edwards et al.
4,821,800 A 4/1989 Scott et al.
4,856,590 A 8/1989 Caillier
4,899,835 A 2/1990 Cherrington
4,917,183 A 4/1990 Gaidry et al.
4,944,349 A 7/1990 Von Gonten, Jr.
4,974,674 A 12/1990 Wells
4,997,037 A 3/1991 Coston
4,998,585 A 3/1991 Newcomer et al.
5,004,049 A 4/1991 Arterbury
5,016,710 A 5/1991 Renard et al.
5,040,283 A 8/1991 Pelgrom
5,060,737 A 10/1991 Mohn
5,107,927 A 4/1992 Whiteley et al.
5,132,903 A 7/1992 Sinclair
5,156,811 A 10/1992 White
5,188,191 A 2/1993 Tomek
5,217,076 A 6/1993 Masek
5,333,684 A 8/1994 Walter et al.
5,337,821 A 8/1994 Peterson
5,339,895 A 8/1994 Arterbury et al.
5,339,897 A 8/1994 Leaute
5,355,956 A 10/1994 Restarick
5,377,750 A 1/1995 Arterbury et al.
5,381,864 A 1/1995 Nguyen et al.
5,384,046 A 1/1995 Lotter et al.
5,431,346 A 7/1995 Sinaisky
5,435,393 A 7/1995 Brekke et al.
5,435,395 A 7/1995 Connell
5,439,966 A 8/1995 Graham et al.
5,511,616 A 4/1996 Bert
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols et al.
5,829,520 A 11/1998 Johnson
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,944,446 A 8/1999 Hocking
5,982,801 A 11/1999 Deak
6,044,869 A 4/2000 Koob
6,068,015 A 5/2000 Pringle
6,098,020 A 8/2000 Den Boer
6,112,815 A 9/2000 Bøe et al.
6,112,817 A 9/2000 Voll et al.
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron et al.
6,301,959 B1 10/2001 Hrametz et al.
6,305,470 B1 10/2001 Woie
6,325,152 B1 12/2001 Kelley et al.
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnarson et al.
6,530,431 B1 3/2003 Castano-Mears et al.
6,561,732 B1 5/2003 Bloomfield et al.
6,581,681 B1 6/2003 Zimmerman et al.
6,581,682 B1 6/2003 Parent et al.
6,622,794 B2 9/2003 Zisk, Jr.
6,632,527 B1 10/2003 McDaniel et al.
6,635,732 B2 10/2003 Mentak
6,667,029 B2 12/2003 Zhong et al.
6,679,324 B2 1/2004 Den Boer et al.
6,692,766 B1 2/2004 Rubinstein et al.
6,699,503 B1 3/2004 Sako et al.
6,699,611 B2 3/2004 Kim et al.
6,712,154 B2 3/2004 Cook et al.
6,722,437 B2 4/2004 Vercaemer et al.
6,786,285 B2 9/2004 Johnson et al.
6,817,416 B2 11/2004 Wilson et al.
6,820,690 B2 11/2004 Vercaemer et al.
6,830,104 B2 12/2004 Nguyen et al.
6,831,044 B2 12/2004 Constien
6,840,321 B2 1/2005 Restarick et al.
6,857,476 B2 2/2005 Richards
6,863,126 B2 3/2005 McGlothen et al.
6,896,049 B2 5/2005 Moyes
6,913,079 B2 7/2005 Tubel
6,938,698 B2 9/2005 Coronado
6,951,252 B2 10/2005 Restarick et al.
6,959,764 B2 11/2005 Preston
6,976,542 B2 12/2005 Henriksen et al.
7,011,076 B1 3/2006 Weldon et al.
7,032,675 B2 4/2006 Steele et al.
7,059,410 B2 * 6/2006 Bousche et al. ..... 166/296
7,084,094 B2 8/2006 Gunn et al.
7,159,656 B2 1/2007 Eoff et al.
7,185,706 B2 3/2007 Freyer
7,207,385 B2 4/2007 Smith et al.
7,252,162 B2 8/2007 Akinlade et al.
7,258,166 B2 8/2007 Russell
7,264,047 B2 * 9/2007 Brezinski et al. ..... 166/202
7,290,606 B2 11/2007 Coronado et al.
7,290,610 B2 11/2007 Corbett et al.
7,318,472 B2 1/2008 Smith
7,322,412 B2 1/2008 Badalamenti et al.
7,325,616 B2 2/2008 Lopez de Cardenas et al.
7,360,593 B2 4/2008 Constien
7,367,399 B2 5/2008 Steele et al.
7,395,858 B2 7/2008 Barbosa et al.
7,398,822 B2 7/2008 Meijer et al.
7,409,999 B2 8/2008 Henriksen et al.

| | | | |
|---|---|---|---|
| 7,413,022 | B2 | 8/2008 | Broome et al. |
| 7,451,814 | B2 | 11/2008 | Graham et al. |
| 7,469,743 | B2 | 12/2008 | Richards |
| 7,581,593 | B2 | 9/2009 | Pankratz et al. |
| 7,621,326 | B2 | 11/2009 | Crichlow |
| 7,644,854 | B1 | 1/2010 | Holmes et al. |
| 7,647,966 | B2 | 1/2010 | Cavender et al. |
| 7,673,678 | B2 | 3/2010 | MacDougall et al. |
| 7,757,757 | B1 | 7/2010 | Vroblesky |
| 2002/0020527 | A1 | 2/2002 | Kilaas |
| 2002/0125009 | A1 | 9/2002 | Wetzel et al. |
| 2002/0148610 | A1 | 10/2002 | Bussear et al. |
| 2002/0170717 | A1 | 11/2002 | Venning et al. |
| 2003/0221834 | A1 | 12/2003 | Hess et al. |
| 2004/0052689 | A1 | 3/2004 | Yao |
| 2004/0060705 | A1 | 4/2004 | Kelley |
| 2004/0094307 | A1 | 5/2004 | Daling et al. |
| 2004/0144544 | A1 | 7/2004 | Freyer |
| 2004/0159447 | A1 | 8/2004 | Bissonnette et al. |
| 2004/0194971 | A1 | 10/2004 | Thomson |
| 2004/0244988 | A1 | 12/2004 | Preston |
| 2005/0016732 | A1 | 1/2005 | Brannon et al. |
| 2005/0086807 | A1 | 4/2005 | Richard et al. |
| 2005/0126776 | A1 | 6/2005 | Russell |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2005/0274515 | A1 | 12/2005 | Smith et al. |
| 2006/0032630 | A1 | 2/2006 | Heins |
| 2006/0042798 | A1 | 3/2006 | Badalamenti et al. |
| 2006/0048936 | A1 | 3/2006 | Fripp et al. |
| 2006/0048942 | A1 | 3/2006 | Moen et al. |
| 2006/0076150 | A1 | 4/2006 | Coronado et al. |
| 2006/0086498 | A1 | 4/2006 | Wetzel et al. |
| 2006/0108114 | A1 | 5/2006 | Johnson |
| 2006/0118296 | A1 | 6/2006 | Dybevik et al. |
| 2006/0124360 | A1 | 6/2006 | Lee et al. |
| 2006/0157242 | A1 | 7/2006 | Graham et al. |
| 2006/0175065 | A1 | 8/2006 | Ross |
| 2006/0185849 | A1 | 8/2006 | Edwards et al. |
| 2006/0250274 | A1 | 11/2006 | Mombourquette et al. |
| 2006/0272814 | A1 | 12/2006 | Broome et al. |
| 2006/0273876 | A1 | 12/2006 | Pachla et al. |
| 2007/0012444 | A1 | 1/2007 | Horgan et al. |
| 2007/0039741 | A1 | 2/2007 | Hailey, Jr. |
| 2007/0044962 | A1 | 3/2007 | Tibbles |
| 2007/0045266 | A1 | 3/2007 | Sandberg et al. |
| 2007/0056729 | A1 | 3/2007 | Pankratz et al. |
| 2007/0131434 | A1 | 6/2007 | MacDougall et al. |
| 2007/0181299 | A1 | 8/2007 | Chung et al. |
| 2007/0209799 | A1 | 9/2007 | Vinegar et al. |
| 2007/0246210 | A1 | 10/2007 | Richards |
| 2007/0246213 | A1 | 10/2007 | Hailey, Jr. |
| 2007/0246225 | A1 | 10/2007 | Hailey, Jr. et al. |
| 2007/0246407 | A1 | 10/2007 | Richards et al. |
| 2007/0272408 | A1 | 11/2007 | Zazaovsky et al. |
| 2007/0289749 | A1 | 12/2007 | Wood et al. |
| 2008/0035349 | A1 | 2/2008 | Richard |
| 2008/0035350 | A1 | 2/2008 | Henriksen et al. |
| 2008/0053662 | A1 | 3/2008 | Williamson et al. |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0169099 | A1 | 7/2008 | Pensgaard |
| 2008/0236839 | A1 | 10/2008 | Oddie |
| 2008/0236843 | A1 | 10/2008 | Scott et al. |
| 2008/0251255 | A1 | 10/2008 | Forbes et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0057014 | A1 | 3/2009 | Richard et al. |
| 2009/0071646 | A1 | 3/2009 | Pankratz et al. |
| 2009/0101330 | A1 | 4/2009 | Johnson |
| 2009/0101342 | A1 | 4/2009 | Gaudette et al. |
| 2009/0133869 | A1 | 5/2009 | Clem |
| 2009/0133874 | A1 | 5/2009 | Dale et al. |
| 2009/0139717 | A1 | 6/2009 | Richard et al. |
| 2009/0139727 | A1 | 6/2009 | Tanju et al. |
| 2009/0194282 | A1 | 8/2009 | Beer et al. |
| 2009/0205834 | A1 | 8/2009 | Garcia et al. |
| 2009/0301704 | A1 | 12/2009 | Dillett et al. |
| 2010/0126720 | A1 | 5/2010 | Kaiser et al. |

FOREIGN PATENT DOCUMENTS

| | | |
|---|---|---|
| GB | 1492345 | 6/1976 |
| GB | 2341405 | 3/2000 |
| JP | 59089383 | 5/1984 |
| SU | 1335677 | 8/1985 |
| WO | 9403743 | 2/1994 |
| WO | 0079097 | 12/2000 |
| WO | 0165063 | 9/2001 |
| WO | 0177485 | 10/2001 |
| WO | 0192681 A1 | 12/2001 |
| WO | 02075110 | 9/2002 |
| WO | 2004018833 A1 | 3/2004 |
| WO | 2006015277 | 2/2006 |
| WO | 2008092241 A1 | 8/2008 |

OTHER PUBLICATIONS

International Search Report and Written Opinion; Date of Mailing Jan. 13, 2011; International Appln No. PCT/US2010/034750; International Search Report 5 pages; Written Opinion 3 pages.

International Search Report and Written Opinion; Date of Mailing Jan. 27, 2011, International Appln No. PCT/US2010/034758; International Search Report 10 pages; Written Opinion 3 pages.

Mackenzie, Gordon Adn Garfield, Garry, Baker Oil Tools, Wellbore Isolation Intervention Devices Utilizing a Metal-to-Metal Rather Than an Elastomeric Sealing Methodology, SPE 109791, Society of Petroleum Engineers, Presentation at the 2007 SPE Annual Technical Conference and Exhibition held in Anaheim, California, U.S.A., Nov. 11-14, 2007, pp. 1-5.

Baker Hughes, Thru-Tubing Intervention, Z-Seal Technology, Z-Seal Metal-to-Metal Sealing Technology Shifts the Paradigm,http://www.bakerhughes.com/assets/media/brochures/4d121c2bfa7e1c7c9c00001b/file/30574t-ttintervention_catalog-1110.pdf.pdf&fs=4460520, 2010 pp. 79-81.

International Search Report and Written Opinion, Mailed Feb. 2, 2010, International Appln. No. PCT/US2009/049661, Written Opinion 7 pages, International Search Report 3 pages.

"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.

"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Baker Oil Tools, Product Report, Sand Control Systems: Screens, Equalizer CF Product Family No. H48688. Nov. 2005. 1 page.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 595.

Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHFJ2QK.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, Mar.; pp. 13-18; 1997 Society of Petroleum Engieneers.

Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.

Dinarvand. R., D'Emanuele, A (1995) The use of thermoresponsive hydrogels for on-off release of molecules, J. Control. Rel. 36 221-227.
E.L. Joly, et al. New Production Logging Technique for Horizontal Wells. SPE 14463 1988.
Hackworth, et al. "Development and First Application of Bistable Expandable Sand Screen," Society of Petroleum Engineers: SPE 84265. Oct. 5-8, 2003. 14 pages.
Henry Restarick, "Horizontal Completion Options in Reservoirs with Sand Problems". SPE 29831. Mar. 11-14, 1995. pp. 545-560.
Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.
Mathis, Stephen P. "Sand Management: A Review of Approaches and Conerns," SPE 82240, The Hague, The Netherlands, May 13-14, 2003. 7 pages.
Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29 Houston, Texas, 2004, Society of Patent Engineers.
Pardo, et al. "Completion, Techniques Used in Horizontal Wells Drilled in Shallow Gas Sands in the Gulf of Mexio". SPE 24842. Oct. 4-7, 1992.
R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.
Tanaka, T., Ricka, J., (1984) Swelling of Ionic gels: Quantitative performance of the Donnan Thory, Macromolecules, 17, 2916-2921.
Tanaka, T., Nishio, I., Sun, S.T., Uena-Nisho, S. (1982) Collapse of gels in an electric field, Science, 218-467-469.
Notification of Transmittal of the International Search Report and the Written Opinion of the International Searching Authority; PCT Application No. PCT/US2010/034747; Mailed Dec. 13, 2010; Korean Intellectual Property Office.
Notification of Transmittal of the International Search Report and the Written Opinion of the International Searching Authority; PCT Application No. PCT/US2010/034750; Mailed Jan. 13, 2010; Korean Intellectual Property Office.

* cited by examiner

PERMEABILITY FLOW BALANCING WITHIN INTEGRAL SCREEN JOINTS AND METHOD

BACKGROUND

Viscous hydrocarbon recovery is a segment of the overall hydrocarbon recovery industry that is increasingly important from the standpoint of global hydrocarbon reserves and associated product cost. In view hereof, there is increasing pressure to develop new technologies capable of producing viscous reserves economically and efficiently. Steam Assisted Gravity Drainage (SAGD) is one technology that is being used and explored with good results in some wellbore systems. Other wellbore systems however where there is a significant horizontal or near horizontal length of the wellbore system present profile challenges both for heat distribution and for production. In some cases, similar issues arise even in vertical systems.

Both inflow and outflow profiles (e.g. production and stimulation) are desired to be as uniform as possible relative to the particular borehole. This should enhance efficiency as well as avoid early water breakthrough. Breakthrough is clearly inefficient as hydrocarbon material is likely to be left in situ rather than being produced. Profiles are important in all well types but it will be understood that the more viscous the target material the greater the difficulty in maintaining a uniform profile.

Another issue in conjunction with SAGD systems is that the heat of steam injected to facilitate hydrocarbon recovery is sufficient to damage downhole components due to thermal expansion of the components. This can increase expenses to operators and reduce recovery of target fluids. Since viscous hydrocarbon reserves are likely to become only more important as other resources become depleted, configurations and methods that improve recovery of viscous hydrocarbons from earth formations will continue to be well received by the art.

SUMMARY

A method for uniform heating of a formation including applying a high temperature fluid to a tubular located within an open hole formation borehole; modifying a permeability of the tubular along its length by reducing permeability at a heel of the borehole and by increasing permeability towards a toe of the borehole; and impeding annular movement of the heated fluid by radially extending one or more baffles from the tubular.

BRIEF DESCRIPTION OF THE DRAWINGS

Referring now to the drawings wherein like elements are numbered alike in the several figures.

DETAILED DESCRIPTION

Figure 1:
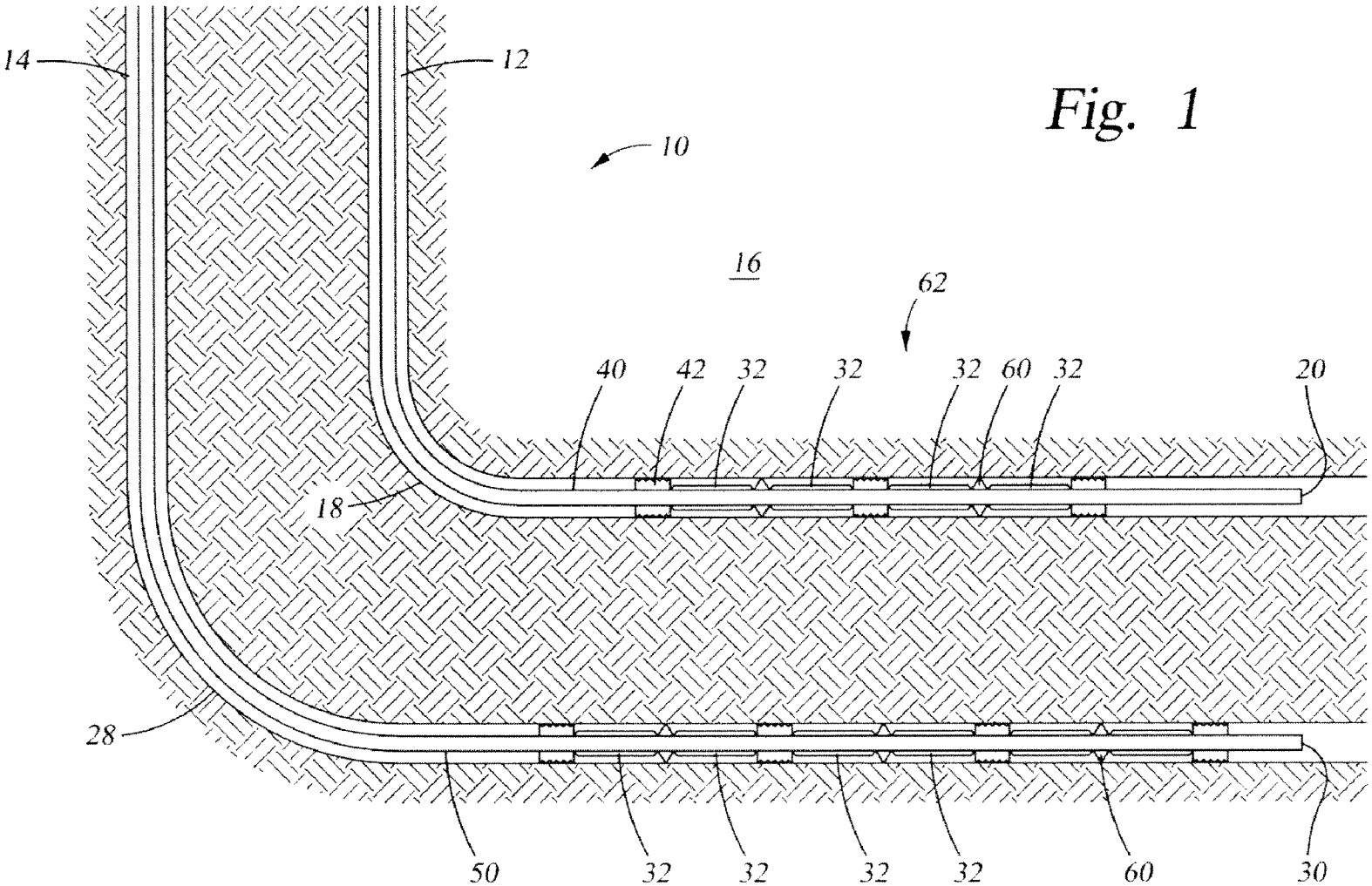
FIG. 1 is a schematic view of a wellbore system in a viscous hydrocarbon reservoir.

Referring to FIG. 1, the reader will recognize a schematic illustration of a portion of a SAGD wellbore system 10 configured with a pair of boreholes 12 and 14. Generally, borehole 12 is the steam injection borehole and borehole 14 is the hydrocarbon recovery borehole but the disclosure should not be understood as limiting the possibilities to such. The discussion herein however will address the boreholes as illustrated. Steam injected in borehole 12 heats the surrounding formation 16 thereby reducing the viscosity of the stored hydrocarbons and facilitating gravity drainage of those hydrocarbons. Horizontal or other highly deviated well structures like those depicted tend to have greater fluid movement into and to of the formation at a heel 18 of the borehole than at a toe 20 of the borehole due simply to fluid dynamics. An issue associated with this property is that the toe 20 will suffer reduced steam application from that desired while heel 18 will experience more steam application than that desired, for example. The change in the rate of fluid movement is relatively linear (declining flow) when querying the system at intervals with increasing distance from the heel 18 toward the toe 20. The same is true for production fluid movement whereby the heel 28 of the production borehole 14 will pass more of the target hydrocarbon fluid than the toe 30 of the production borehole 14. This is due primarily to permeability versus pressure drop along the length of the borehole 12 or 14. The system 10 as illustrated alleviates this issue as well as others noted above.

Figure 2:
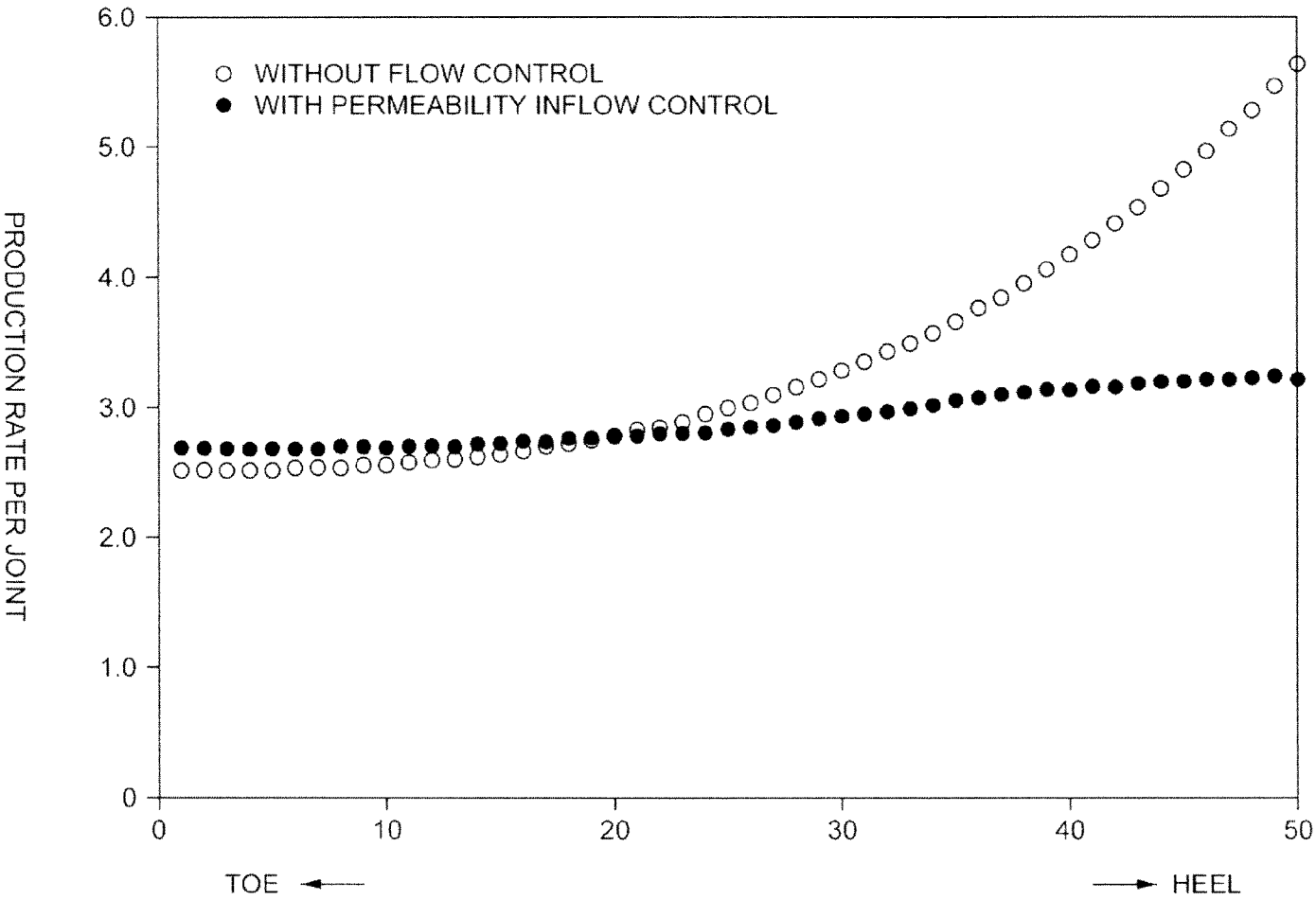
FIG. 2 is a chart illustrating a change in fluid profile over a length of the borehole with and without permeability control.

According to the teaching herein, one or more of the boreholes (represented by just two boreholes 12 and 14 for simplicity in illustration) is configured with one or more permeability control devices 32 that are each configured differently with respect to permeability or pressure drop in flow direction in or out of the tubular. The devices 32 nearest the heel 18 or 28 will have the least permeability while permeability will increase in each device 32 sequentially toward the toe 20 and 30. The permeability of the device 32 closest to toe 20 or 30 will be the greatest. This will tend to balance outflow of injected fluid and inflow of production fluid over the length of the borehole 12 and 14 because the natural pressure drop of the system is opposite that created by the configuration of permeability devices as described. Permeability and/or pressure drop devices 32 useable in this configuration include inflow control devices such as product family number H48688 commercially available from Baker Oil Tools, Houston Tex., beaded matrix flow control configurations such as those disclosed in U.S. Ser. Nos. 61/052,919, 11/875,584 and 12/144,730, 12/144,406 and 12/171,707 the disclosures of which are incorporated herein by reference, or other similar devices. Adjustment of pressure drop across individual permeability devices is possible in accordance with the teaching hereof such that the desired permeability over the length of the borehole 12 or 14 as described herein is achievable. Referring to FIG. 2, a chart of the flow of fluid over the length of borehole 12 is shown without permeability control and with permeability control. The representation is stark with regard to the profile improvement with permeability control.

In order to determine the appropriate amount of permeability for particular sections of the borehole 12 or 14, one needs to determine the pressure in the formation over the length of the horizontal borehole. Formation pressure can be determined/measured in a number of known ways. Pressure at the heel of the borehole and pressure at the toe should also be determined/measured. This can be determined in known ways. Once both formation pressure and pressures at locations within the borehole have been ascertained, the change in pressure ($\Delta P$) across the completion can be determined for each location where pressure within the completion has been or is tested. Mathematically this is expressed as $\Delta P$ location=P formation−P location where the locations may be the heel, the toe or any other point of interest.

A flow profile whether into or out of the completion is dictated by the $\Delta P$ at each location and the pressure inside the completion is dictated by the head of pressure associated with the column of fluid extending to the surface. The longer the column, the higher the pressure. It follows, then, that greater resistance to inflow will occur at the toe of the borehole than at the heel of the completion. In accordance with the teaching hereof permeability control is distributed such that pressure drop at a toe of the borehole is in the range of about 25% to less than 1% whereas pressure drop at the heel of the borehole is about 30% or more. In one embodiment the pressure drop at the heel is less than 45% and at the toe less than about 25%. Permeability control devices distributed between the heel and the toe will in some embodiments have individual pressure drop values between the percentage pressure drop at the toe and the percentage pressure drop at the heel. Moreover, in some embodiments the distribution of pressure drops among the permeability devices is linear while in other embodiments the distribution may follow a curve or may be discontinuous to promote inflow of fluid from areas of the formation having larger volumes of desirable liberatable fluid and reduced inflow of fluid from areas of the formation having smaller volumes of desirable liberatable fluid.

Referring back to FIG. 1, a tubing string 40 and 50 are illustrated in boreholes 12 and 14 respectively. Open hole anchors 42, such as Baker Oil Tools WBAnchor™ may be employed in the borehole to anchor the tubing 40. This is helpful in that the tubing 40 experiences a significant change in thermal load and hence a significant amount of thermal expansion during well operations. Unchecked, the thermal expansion can cause damage to other downhole structures or to the tubing string 40 itself thereby affecting efficiency and production of the well system. In order to overcome this problem, one or more open hole anchors 42 are used to ensure that the tubing string 40 is restrained from excessive movement. Because the total length of mobile tubing string is reduced by the interposition of open hole anchor(s) 42, excess extension cannot occur. In one embodiment, three open hole anchors 42, as illustrated, are employed and are spaced by about 90 to 120 ft from one another but could in some particular applications be positioned more closely and even every 30 feet (at each pipe joint). The spacing interval is also applicable to longer runs with each open hole anchor being spaced about 90-120 ft from the next. Moreover, the exact spacing amount between anchors is not limited to that noted in this illustrated embodiment but rather can be any distance that will have the desired effect of reducing thermal expansion related wellbore damage. In addition the spacing can be even or uneven as desired. The determination of distance between anchors must take into account. The anchor length, pattern, or the number of anchor points per foot in order to adjust the anchoring effect to optimize performance based on formation type and formation strength tubular dimensions and material.

Finally in one embodiment, the tubing string 40, 50 or both is configured with one or more baffles 60. Baffles 60 are effective in both deterring loss of steam to formation cracks such as that illustrated in FIG. 1 as numeral 62 and in causing produced fluid to migrate through the intended permeability device 32. More specifically, and taking the functions one at a time, the injector borehole, such as 12, is provided with one or more baffles 60. The baffles may be of any material having the ability to withstand the temperature at which the particular steam is injected into the formation. As shown in FIG. 1, the baffles 60 may include a substantially pointed cross-section tapered to a substantially pointed end where the pointed end is radially extended to contact the borehole 12 or 14. In one embodiment, a metal deformable seal such as one commercially known as a z-seal and available from Baker Oil Tools, Houston Texas, may be employed. And while metal deformable seals are normally intended to create a high pressure high temperature seal against a metal casing within which the seal is deployed, for the purposes taught in this disclosure, it is not necessary for the metal deformable seal to create an actual seal. That stated however, there is also no prohibition to the creation of a seal but rather then focus is upon the ability of the configuration to direct steam flow with relatively minimal leakage. In the event that an actual seal is created with the open hole formation, the intent to minimize leakage will of course be met. In the event that a seal is not created but substantially all of the steam applied to a particular region of the wellbore is delivered to that portion of the formation then the baffle will have done its job and achieved this portion of the intent of this disclosure. With respect to production, the baffles are also of use in that the drawdown of individual portions of the well can be balanced better with the baffles so that fluids from a particular area are delivered to the borehole in that area and fluids from other areas do not migrate in the annulus to the same section of the borehole but rather will enter at their respective locations. This ensures that profile control is maintained and also that where breakthrough does occur, a particular section of the borehole can be bridged and the rest will still produce target fluid as opposed to breakthrough fluid since annular flow will be inhibited by the baffles. In one embodiment baffles are placed about 100 ft or 3 liner joints apart but as noted with respect to the open hole anchors, this distance is not fixed but may be varied to fit the particular needs of the well at issue. The distance between baffles may be even or may be uneven and in some cases the baffles will be distributed as dictated by formation condition such that for example cracks in the formation will be taken into account so that a baffle will be positioned on each side of the crack when considered along the length of the tubular.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A method for uniform heating of a formation comprising:

applying a high temperature fluid to a tubular located within an open hole formation borehole;

modifying a permeability of the tubular along its length by reducing permeability at a heel of the borehole and by increasing permeability towards a toe of the borehole; and impeding annular movement of the heated fluid by radially extending one or more baffles having a substantially pointed cross-section from the tubular to the formation borehole.

2. A method as claimed in claim 1 wherein the method further comprises anchoring a plurality of portions of the tubular; and restricting thermal growth of the tubular with the plurality of anchors.

3. A method as claimed in claim 1 wherein the impeding is by sealing an annulus defined between the tubular and the formation.

4. A method as claimed in claim 1 wherein the impeding is by extending the baffles into contact with the formation.

5. A method as claimed in claim 1 wherein the applying is by injecting steam into the tubular.

6. A method as claimed in claim 1 wherein the modifying is by positioning one or more permeability control devices in the tubular to control pressure drop across the tubular.

7. A method as claimed in claim 6 wherein the permeability control devices are configured to be less permeable at a heel of the borehole than at a toe of the borehole.

8. A method as claimed in claim 6 wherein the one or more permeability control devices is a number of devices positioned in the tubular each having a distinct permeability which increases as the devices become closer to the toe.

9. A method as claimed in claim 1 wherein the impeding is forcing high temperature fluid to enter the formation in discrete areas between the one or more baffles.

10. A method as claimed in claim 1 further includes creating a uniformly distributed temperature profile in the formation.

11. The method as claimed in claim 1, wherein radially extending one or more baffles includes employing a metal deformable seal.

12. The method as claimed in claim 1, wherein the substantially pointed cross-section of the one or more baffles includes a tapered cross-section having a substantially pointed end, and radially extending the one or more baffles includes contacting the formation borehole with the pointed end of the one or more baffles.

* * * * *